United States Patent [19]

Clancy

[11] 4,058,280

[45] Nov. 15, 1977

[54] TABLE RAIL

[76] Inventor: Timothy Clancy, 981 McAllister Ave., Columbus, Ohio 43205

[21] Appl. No.: 707,330

[22] Filed: July 21, 1976

[51] Int. Cl.[2] ..... A47B 21/00

[52] U.S. Cl. ..... 248/2; 125/14

[58] Field of Search ..... 248/2, 226 R, 226 A, 248/226 B, 226 D; 51/241 S, 35; 52/291, 657; 125/14; 83/471.2, 471.3, 485, 486, 486.1; 144/134 B, 134 C

[56] References Cited

U.S. PATENT DOCUMENTS

| | | | |
|---|---|---|---|
| 2,592,001 | 4/1952 | Bereit | 125/14 |
| 2,696,644 | 12/1954 | De Graw | 52/291 |
| 2,774,191 | 12/1956 | Bouchez | 125/14 |
| 3,566,932 | 3/1971 | Papenmeier | 83/471.2 |
| 3,827,468 | 8/1974 | Markham | 144/136 R |

FOREIGN PATENT DOCUMENTS

| | | | |
|---|---|---|---|
| 149,336 | 11/1931 | Switzerland | 52/291 |

*Primary Examiner*—Robert A. Hafer

[57] ABSTRACT

An apparatus that is mountable upon a work table, and which is used to support various portable power tools during operative use, so as to work efficiently and accurately; the apparatus including a vertical table frame stationarily mounted upon the table, the table frame including rails, along which there can be rolled a back plate of a carrier assembly, the carrier assembly being adaptable for various power tools to be attached thereto.

6 Claims, 8 Drawing Figures

TABLE RAIL

This invention relates generally to apparatus for supporting portable power tools during operative use.

A principal object of the present invention is to provide a table rail designed to accommodate many existing portable power tools, so that a maximum use can be made of the capabilities accurately, such power tools comprising either portable circular saws, jig saw, glass cutter, and other cutting instruments.

Another object is to provide a table rail, which permits handling large four feet by eight feet sheets of paneling, plywood, plexiglass or glass.

Yet a further object is to provide a table rail, wherein portable tools move on a preset track, while materials being worked upon remain at rest, thereby differing from conventional apparatus, wherein the tools are fixed and the materials are in motion.

Still another object is to provide a table rail, which replaces both a table saw and a radial arm saw, thus converting the portable circular saw to two extra uses.

Still another object is to provide a table rail, wherein, while the converted table saw cuts from underneath, the table rail cuts from on top, allowing complete visibility to an operator, thus promoting safety and greater accuracy.

Still a further object is to provide a table rail, in which a saw can be used throughout the entire length of the rail, while a radial arm saw is limited to the function of its design.

Still a further object is to provide a table rail, which is more flexible and adaptable.

Other objects are to provide a table rail, which is simple in design, inexpensive to manufacture, rugged in construction, easy to use and efficient in operation.

These and other objects will be readily evident upon a study of the following specification, and the accompanying drawings, wherein.

Figure 1:
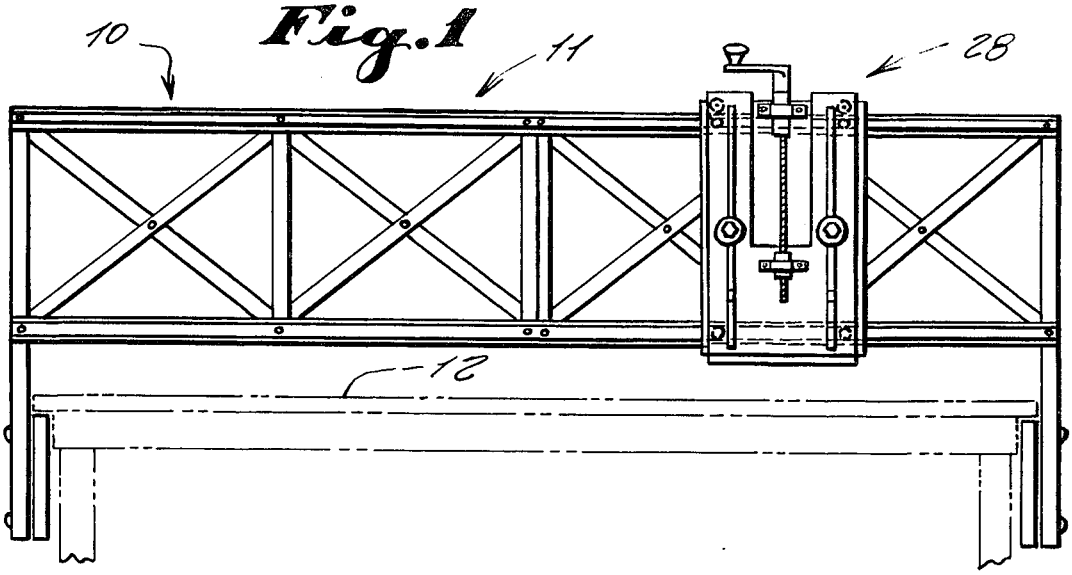
FIG. 1 is a front elevation view of the table rail.
Figure 2:
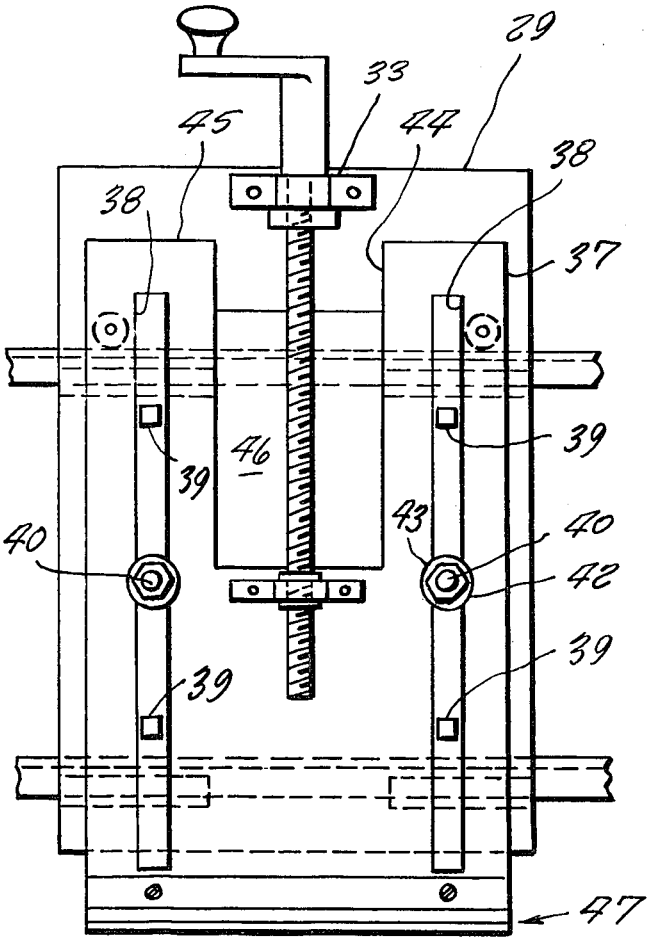
FIG. 2 is a front view of the carrier assembly.
Figure 3A:
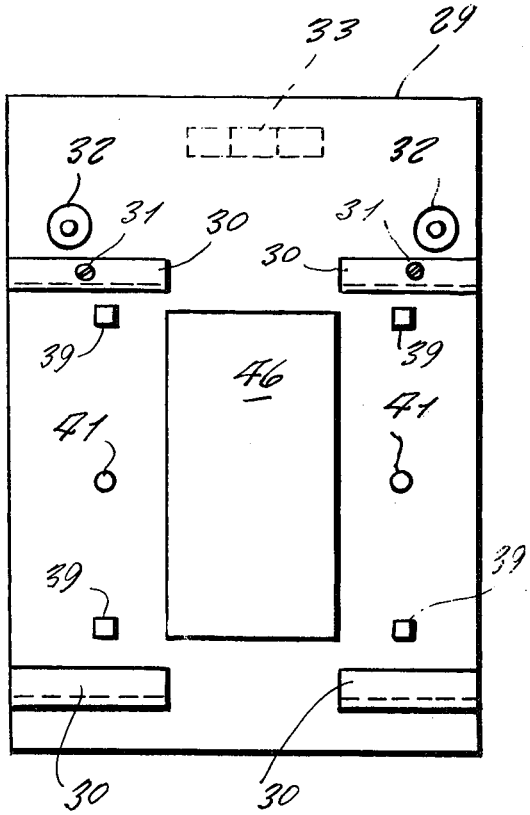
FIG. 3 is an end view of the table rail, and showing the carrier assembly detached from a back plate thereof.
Figure 3:
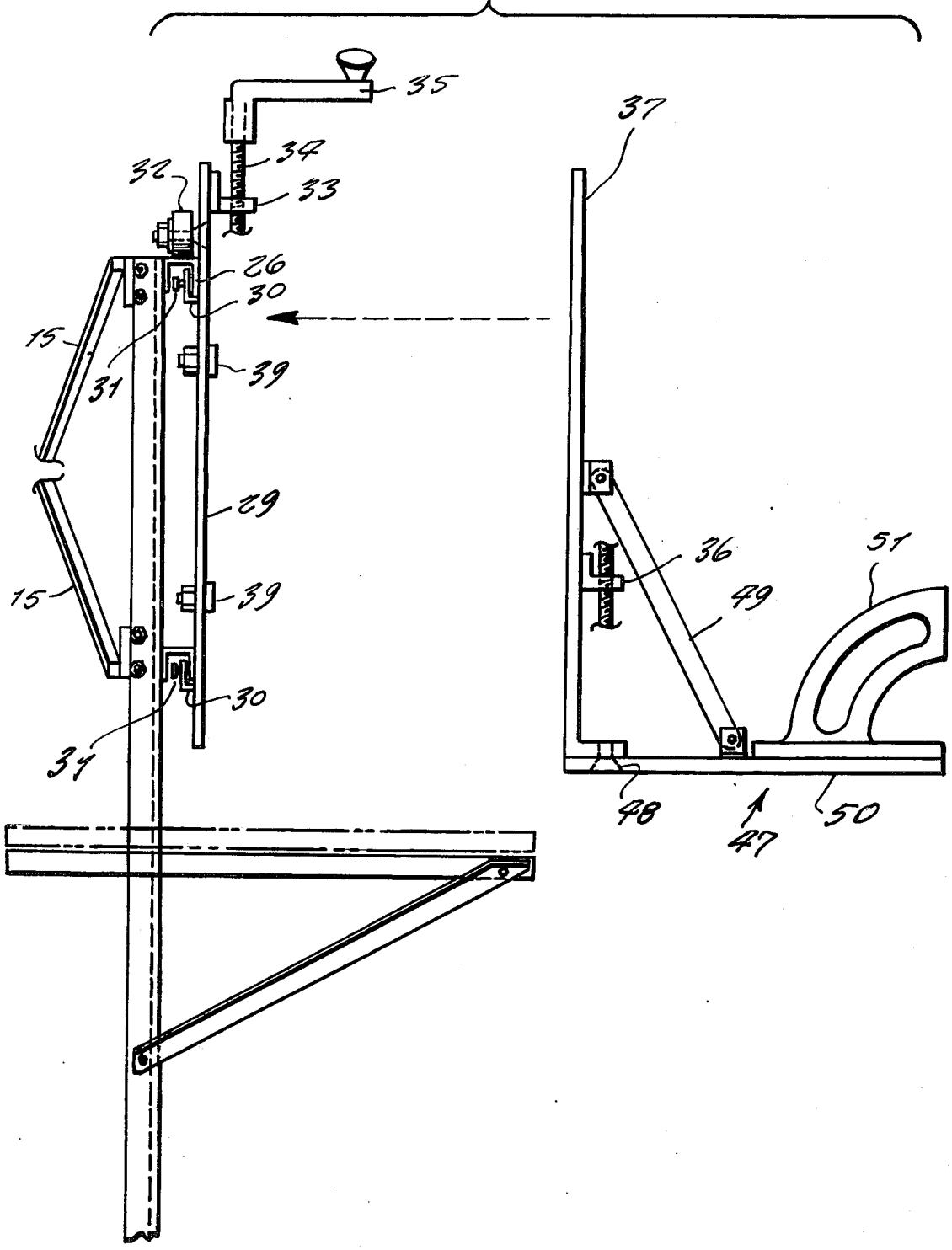
Figure 4:
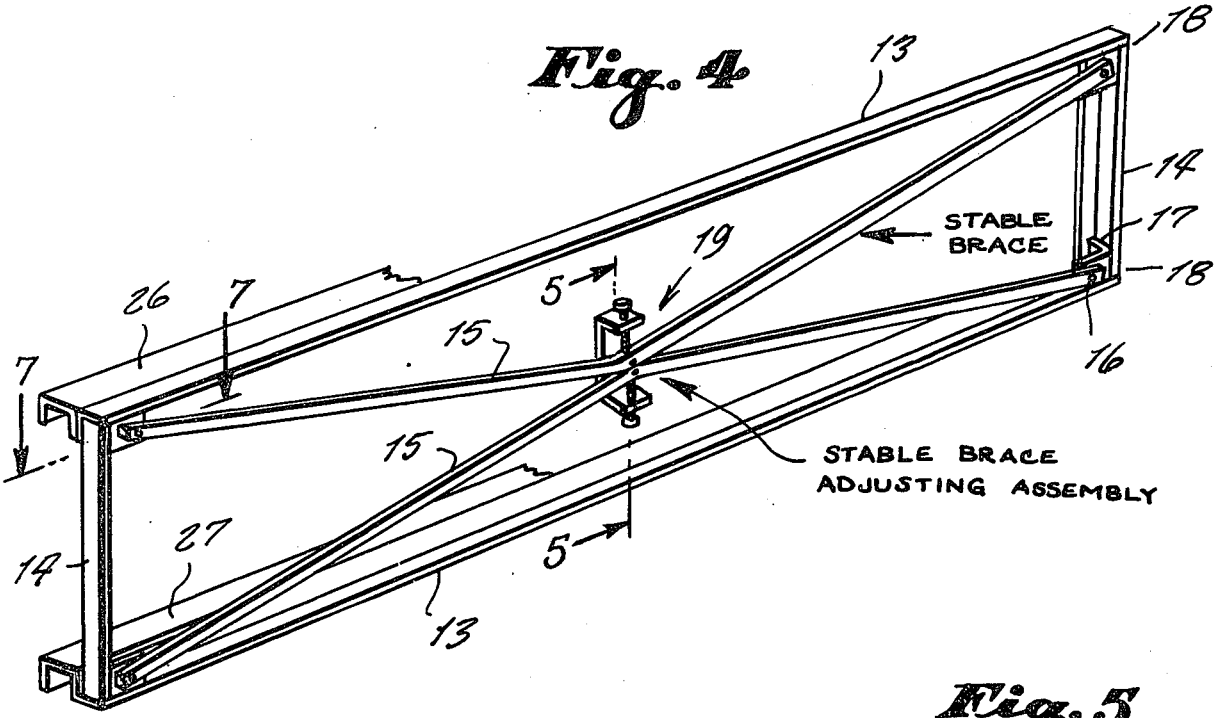
Figure 5:
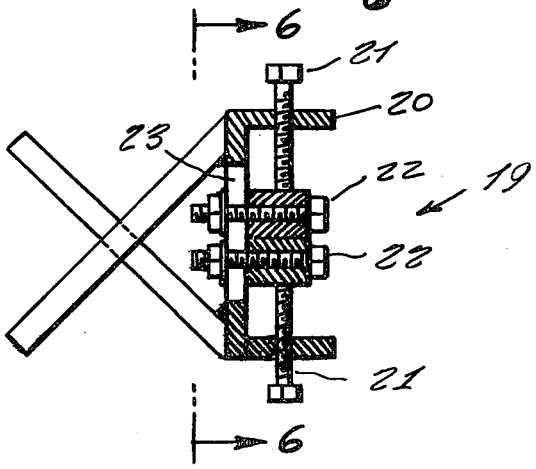
Figure 6:
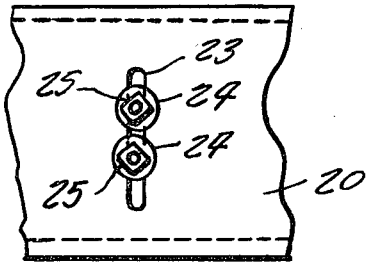
Figure 7:
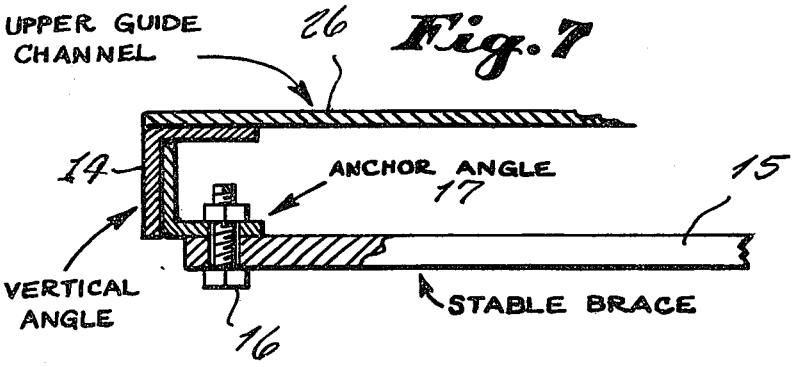

FIG. 3*a* is a rear elevation view of the carrier assembly back plate;

FIG. 4 is a perspective view of the stable frame;

FIG. 5 is an enlarged cross-sectional view taken on line 5—5 of FIG. 4, and illustrating the stable brace adjusting assembly;

FIG. 6 is a view in direction 6—6 of FIG. 5, and showing the stable brace adjusting assembly alignment slot;

FIG. 7 is an enlarged cross-sectional view taken on line 7—7 of FIG. 4, and showing the stable brace attachments.

Referring now to the drawings in greater detail, the reference numeral 10 represents a table rail according to the present invention, wherein there is a stable frame 11 mounted stationarily in a vertical position upon a work table 12.

The stable frame is made of horizontally extending angles 13, and vertical angles 14, welded together at their corners. Upon a rear side of the stable frame, there are a pair of crossing stable braces 15, each of which, at its ends, is secured by means of a bolt 16 through an anchor angle 17, welded in the corners 18 of the stable frame 11. At their longitudinal centers, the stable braces 15 are forcibly pushed toward each other by means of a stable brace adjusting assembly 19, and which includes a channel shaped bracket 20, fitted with aligned upper and lower screws 21, that bear against the stable braces, so as to clamp them therebetween. A transverse extending bolt 22, through a longitudinal center of each stable brace, extends through a slot 23, formed on the channel shaped bracket 20, and each bolt 22 is then fitted with a washer 24 and a nut 25. Thus, the stable braces are firmly locked in a stressed position, so as to form a rigid stable frame.

Upon a front side of the stable frame, there are welded an upper guide channel 26, and a lower guide channel 27, which extend horizontally, adjacent the angles 13 of the stable frame. The upper and lower guide channels serve as rails, along which a carrier assembly 28 is movable, and which carries the portable power tool.

The carrier assembly 28 includes a back plate 29, having angle shaped guide blocks 30, secured to a rear side thereof, and which fit inside the slot of the upper and lower guide channel 15. An adjusting screw 31, on each guide block, serves to lock the back plate in a fixed position, along the upper and lower guide channels, so as to prevent the carrier assembly from travelling along the stable frame. However, when the adjusting screws 31 are loosened, the back plate can travel along the stable frame by means of rollers 32, that roll upon the upper surface of the upper guide channel 26.

A crank support bearing block 33 is welded to a front side of the back plate 29, and threadingly engages a threaded vertical adjusting rod 34, fitted with a crank handle 35 at its upper end. The lower end of the vertical adjusting rod 34 threadingly engages a block 36 mounted on a front side of a front plate 37 of the carrier assembly. Thus, the front plate can be selectively raised or lowered, respective to the back plate. Precisely, true accurate vertical movement of the front plate, respective to the back plate, is obtained by means of two slots 38 through the front plate, each receiving a pair of guide posts 39, each having a square head, and which fits within the slot. A pair of lock bolts 40 are each receivable through an opening 41 in the back plate, the lock bolts being receivable through the slots 38 of the front plate, and then being fitted with a washer 42, and a nut 43, thus providing a means for rigidly securing the front plate, respective to the back plate, when so desired.

It is to be noted that the front plate 37 includes a notch 44 along a center of its upper edge 45, in order to clear the crank support bearing block 33 of the back plate. Additionally, it should be noted that there is a lightening hole 46, in a center of the back plate.

At the lower end of the front plate 37, there is attached a mounting plate assembly 47, and which is secured thereto by means of screws 48 and braces 49, so that a plate 50, of the mounting plate assembly 47, extends truly horizontal. An equipment mount 51 is affixed upon the upper side of the mounting plate 50. The mount 51 provides a means for attachment of various portable power tools thereto.

Thus there is provided a table rail, which is designed to function as a precision instrument. The rail is mounted on a table, which is calibrated with the rail. The carrier assembly can be moved vertically, by means of the crank handle, and it can travel horizontally by means of the rollers on top of the upper guide channel 26. Horizontal travel is manual, and the tools are pushed or pulled along the rail. Power tools carried by the carrier assembly may each, necessarily, require specially designed mounts for securement thereof to the carrier mounting plate assembly. Thus, for example, the mounting plate for a circular saw will include a bracket that will allow the saw to move from zero degrees to forty five degrees, in relation to the horizontal table top. The work is placed upon the upper surface of the table.

The advantage of the table rail is such, that it is lightweight, so as to make it easy to carry for portability, and is thus advantageous for working men, who travel to a construction site. A saw, or router, movable along the table rail, makes it easier and quicker for cutting any type of board, moulding, trim or any angle without use of a square, a straight chalk line, or the like. Thus, the present invention saves time and construction money.

While various changes may be made in the detail construction, it is understood that such changes will be within the spirit and scope of the present invention, as is defined by the appended claims.

What I claim is:

1. A table rail, comprising in combination, a stable frame mountable in vertical position upon a work table, said stable frame including upper and lower horizontal angles and vertical side angles welded together at their corners, and being strengthened by a pair of stable braces on a rear side thereof, each opposite end of each said stable brace being secured to a corner of said stable frame, and longitudinally center portions of said stable braces being forcibly urged toward each other by means of a stable brace adjusting assembly, said stable brace adjusting assembly comprises a channel shaped bracket fitted with an upper and lower screw in axial alignment, said longitudinally central portions of said stable braces being clamped between said screws, and each said longitudinally center portion of said stable braces having a transverse extending bolt therethrough, extending through a vertical slot in said bracket, and each said bolt then being fitted with a washer and nut.

2. The combination as set forth in claim 1, wherein said stable frame has an upper guide channel and a lower guide channel secured to a front side thereof, said upper and lower guide channels serving as rails, a carrier assembly being horizontally movable along said rails.

3. The combination as set forth in claim 2, wherein said carrier assembly includes a back plate, having angle shaped guide blocks upon a rear side thereof sliding in a groove of said upper and lower guide channel 15, each said guide block being fitted with an adjusting screw for fixedly locking said back plate respective to said stable frame, and a plurality of rollers carried on the rear side of said back plate, said rollers resting upon an upper side of said upper guide channel.

4. The combination as set forth in claim 3, wherein a crank support bearing block mounted upon a front side of said back plate threadingly engages a threaded vertical adjusting rod, having a crank handle at its upper end, a lower portion of said vertical adjusting rod threadingly engaging a block mounted upon a front side of a front plate of said carrier assembly, a lower end of said front plate having a mounting plate assembly secured thereto, said mounting plate assembly including a mounting plate having an equipment mount secured thereupon.

5. The combination as set forth in claim 4, wherein slot guide means are provided between said back plate and said front plate of said carrier assembly.

6. A table rail comprising, in combination, a stable frame mountable in vertical position upon a work table, said frame including horizontally extending upper and lower support members and vertically extending side support members fixedly connected to one another, said upper and lower support members each having a guide channel secured thereto and a carrier assembly mounted on said guide channels for horizontal movement along the length thereof; a pair of stable braces secured to said frame, opposite ends of each of said braces being secured to a respective horizontally disposed corner of said frame, and longitudinally disposed center portions of said braces being forcibly urged toward one another by means of a brace adjusting assembly; and a mounting plate assembly secured to said carrier assembly and provided with mounting means for removably securing selected equipment to said carrier assembly.

* * * * *